US011486590B2

(12) United States Patent
Sakai et al.

(10) Patent No.: US 11,486,590 B2
(45) Date of Patent: Nov. 1, 2022

(54) SOUNDPROOF PART AND OUTDOOR UNIT OF AIR-CONDITIONING APPARATUS

(71) Applicant: Mitsubishi Electric Corporation, Tokyo (JP)

(72) Inventors: Mizuo Sakai, Tokyo (JP); Noka Sakabe, Tokyo (JP); Tetsuya Yamashita, Tokyo (JP); Hirokazu Murakami, Tokyo (JP); Yuya Hata, Tokyo (JP); Motoki Otsuka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/057,778

(22) PCT Filed: Jul. 24, 2018

(86) PCT No.: PCT/JP2018/027663

§ 371 (c)(1),
(2) Date: Nov. 23, 2020

(87) PCT Pub. No.: WO2020/021625

PCT Pub. Date: Jan. 30, 2020

(65) Prior Publication Data

US 2021/0207820 A1 Jul. 8, 2021

(51) Int. Cl.
*F24F 1/12* (2011.01)

(52) U.S. Cl.
CPC ..... *F24F 1/12* (2013.01)

(58) Field of Classification Search
CPC ..... F24F 1/12; F04B 39/0033
(Continued)

(56) References Cited

U.S. PATENT DOCUMENTS

2016/0017116 A1* 1/2016 Lee ..... C08F 2/44 422/131
2018/0080666 A1* 3/2018 Gotou ..... G10K 11/168
2020/0032056 A1* 1/2020 Sterling ..... B29C 48/40

FOREIGN PATENT DOCUMENTS

CN 104553214 A * 4/2015 ..... G10K 11/168
CN 104553214 A 4/2015
(Continued)

OTHER PUBLICATIONS

International Search Report of the International Searching Authority dated Oct. 23, 2018 for the corresponding International application No. PCT/JP2018/027663 (and English translation).
(Continued)

*Primary Examiner* — Steve S Tanenbaum
(74) *Attorney, Agent, or Firm* — Posz Law Group, PLC

(57) ABSTRACT

A soundproof part that covers a compressor includes a side surface cover including two or more sound absorbing materials and two or more sound insulating materials, and configured to cover a side surface of the compressor. The two or more sound insulating materials include sound insulating materials having different specific gravities. The side surface cover is formed such that one sound absorbing material is disposed adjacent to the compressor, and a sound absorbing material and a sound insulating material are alternately arranged. The side surface cover is also formed such that as a distance from the compressor increases, the sound insulating materials having relatively lower specific gravities are disposed.

9 Claims, 10 Drawing Sheets

(58) Field of Classification Search
USPC ..... 62/296
See application file for complete search history.

(56) References Cited

FOREIGN PATENT DOCUMENTS

| | | | | |
|---|---|---|---|---|
| JP | 2010-168940 | A | | 8/2010 |
| JP | 2015-075038 | A | | 4/2015 |
| JP | 2015-135104 | A | | 7/2015 |
| JP | 2015135104 | A | * | 7/2015 |

OTHER PUBLICATIONS

Office Action dated Mar. 29, 2022 issued in corresponding CN Patent Application No. 201880094725.8 (with machine English translation).
Office Action dated Jul. 29, 2022 issued in corresponding CN Patent Application No. 201880094725.8 (and English translation).

* cited by examiner

SOUNDPROOF PART AND OUTDOOR UNIT OF AIR-CONDITIONING APPARATUS

CROSS REFERENCE TO RELATED APPLICATION

This application is a U.S. national stage application of International Application No. PCT/JP2018/027663 filed on Jul. 24, 2018, the contents of which are incorporated herein by reference.

TECHNICAL FIELD

The present disclosure relates to a soundproof part that covers a compressor, and to an outdoor unit of an air-conditioning apparatus that includes the compressor to which the soundproof part is attached.

BACKGROUND ART

In outdoor units of air-conditioning devices, particularly in side-flow-type outdoor units, a compressor is mounted in a machine chamber disposed adjacent to an air-sending device chamber in which an air-sending device and a heat exchanger are mounted. The air-sending device chamber and the machine chamber are partitioned by a separator. The compressor is covered by an outer shell part of the outdoor unit made of sheet metal, or other materials. However, it is difficult to sufficiently prevent sound generated from the compressor by only covering the compressor by the outer shell part. Therefore, in general, a soundproof part is provided around the compressor for the purpose of insulating and absorbing sound.

Recently, dramatic improvements in performance and reductions in the size of the compressor have been achieved and hence, there is a tendency that sound generated from the compressor increases. Sounds with a frequency of 1 kHz or more are acoustically recognized as noise, thus tending to cause discomfort. Generation of such sounds from the compressor directly leads to users' complaints in the market. For this reason, hitherto, a soundproof part is attached to the compressor to prevent leakage of sound to the outside (see Patent Literature 1, for example). The soundproof part disclosed in Patent Literature 1 is formed such that sound absorbing materials and sound insulating materials are accommodated in a sealed non-woven fabric sheet having a bag shape.

CITATION LIST

Patent Literature

Patent Literature 1: Japanese Unexamined Patent Application No. 2015-75038

SUMMARY OF INVENTION

Technical Problem

However, as described above, both surfaces of the soundproof part disclosed in Patent Literature 1 are covered by the non-woven fabric sheets. Therefore, the soundproof part disclosed in Patent Literature 1 has a complicated structure, so that time and labor are required to process the soundproof part. Further, the configuration of the soundproof part disclosed in Patent Literature 1 cannot sufficiently prevent a situation where sound generated from the compressor leaks to the outside.

The present disclosure has been made to overcome the above-mentioned problems, and an object thereof is to provide a soundproof part that prevents leakage of sound generated from the compressor to the outside with a simple structure, and to provide an outdoor unit of an air-conditioning apparatus.

Solution to Problem

A soundproof part according to one embodiment of the present disclosure is a soundproof part that covers a compressor, the soundproof part comprising: a side surface cover including two or more sound absorbing materials and two or more sound insulating materials, and configured to cover a side surface of the compressor, wherein the two or more sound insulating materials include sound insulating materials having different specific gravities, and the side surface cover is formed such that one of the two or more sound absorbing materials is disposed adjacent to the compressor, and the sound absorbing material and the insulating material are alternately arranged, and as a distance from the compressor increases, the sound insulating materials having relatively lower specific gravities are disposed.

An outdoor unit of an air-conditioning apparatus according to another embodiment of the present disclosure includes: a compressor, a heat-source-side heat exchanger, and a heat-source-side air-sending device configured to send air to the heat-source-side heat exchanger; and the soundproof part configured to cover the compressor.

Advantageous Effects of Invention

According to the Embodiment of the present disclosure, in the side surface cover where the sound absorbing material and the sound insulating material are alternately arranged, as the distance from the compressor increases, the sound insulating materials having relatively lower specific gravities are disposed and hence, sound insulating performance can be increased. Accordingly, it is possible to prevent leakage of sound generated from the compressor to the outside with a simple structure.

DESCRIPTION OF EMBODIMENTS

Embodiment 1

Figure 1:
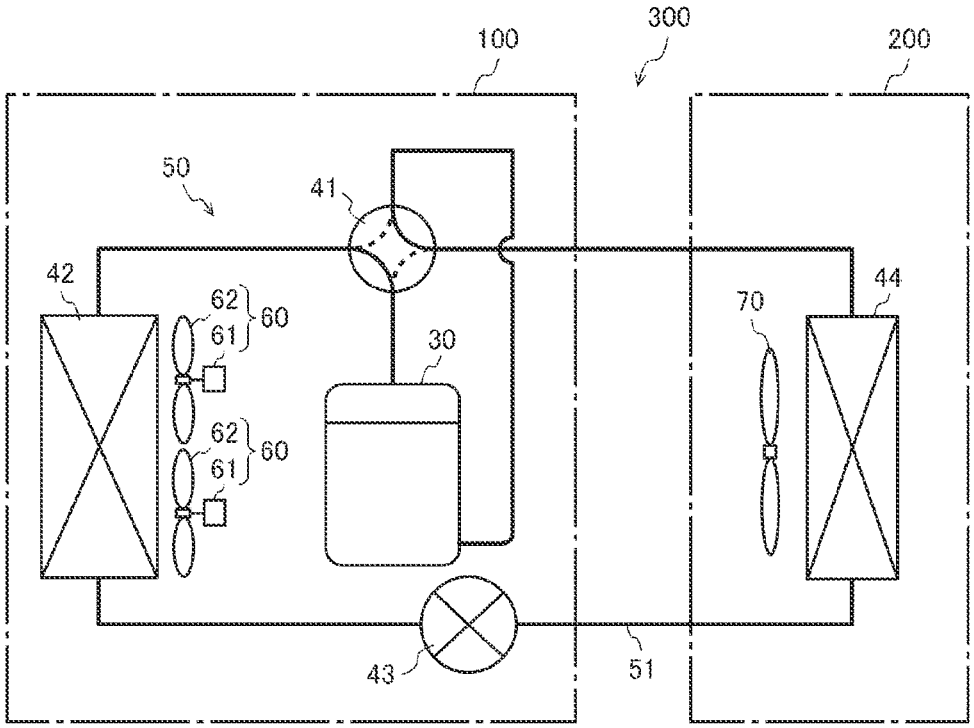
FIG. 1 is a schematic configuration diagram illustrating a refrigerant circuit of an air-conditioning apparatus according to Embodiment 1 of the present disclosure.

FIG. 1 is a schematic configuration diagram illustrating a refrigerant circuit of an air-conditioning apparatus according to Embodiment 1 of the present disclosure. As shown in FIG. 1, an air-conditioning apparatus 300 includes an outdoor unit 100 installed outside, and an indoor unit 200 installed inside. The outdoor unit 100 and the indoor unit 200 are connected with each other via a refrigerant pipe 51. In FIG. 1, a side-flow-type outdoor unit is illustrated as the outdoor unit 100.

The indoor unit 200 is made of a fin-and-tube type heat exchanger, for example, and includes a load-side heat exchanger 44 that causes heat exchange to be performed between indoor air and refrigerant. The outdoor unit 100 includes a compressor 30, a four-way valve 41, a heat-source-side heat exchanger 42, and an expansion valve 43. The compressor 30 is driven by an inverter, for example, and compresses refrigerant. The four-way valve 41 is connected to the discharge side of the compressor 30 to switch the flow passage of refrigerant. The four-way valve 41 is switched to a flow passage shown by a solid line in FIG. 1 during a cooling operation and a defrosting operation, and is switched to a flow passage shown by a broken line in FIG. 1 during a heating operation, for example. The heat-source-side heat exchanger 42 is made of a fin-and-tube type heat exchanger, for example, and causes heat exchange to be performed between outside air and refrigerant. The expansion valve 43 is made of an electronic expansion valve, for example, and causes refrigerant to be expanded by reducing the pressure of the refrigerant. In other words, the air-conditioning apparatus 300 includes a refrigerant circuit 50 formed by connecting the compressor 30, the four-way valve 41, the heat-source-side heat exchanger 42, the expansion valve 43, and the load-side heat exchanger 44 via the refrigerant pipe 51.

The indoor unit 200 includes a load-side air-sending device 70 that is attached to the load-side heat exchanger 44 to send air to the load-side heat exchanger 44. The outdoor unit 100 includes heat-source-side air-sending devices 60 that are attached to the heat-source-side heat exchanger 42 to send air to the heat-source-side heat exchanger 42. FIG. 1 illustrates the case where two heat-source-side air-sending devices 60 are installed in the outdoor unit 100. Each heat-source-side air-sending device 60 includes a fan motor 61 and a fan 62, for example. The fan motor 61 is driven by an inverter. The fan 62 rotates using the fan motor 61 as a power source to send air to the heat-source-side heat exchanger 42.

Figure 2:
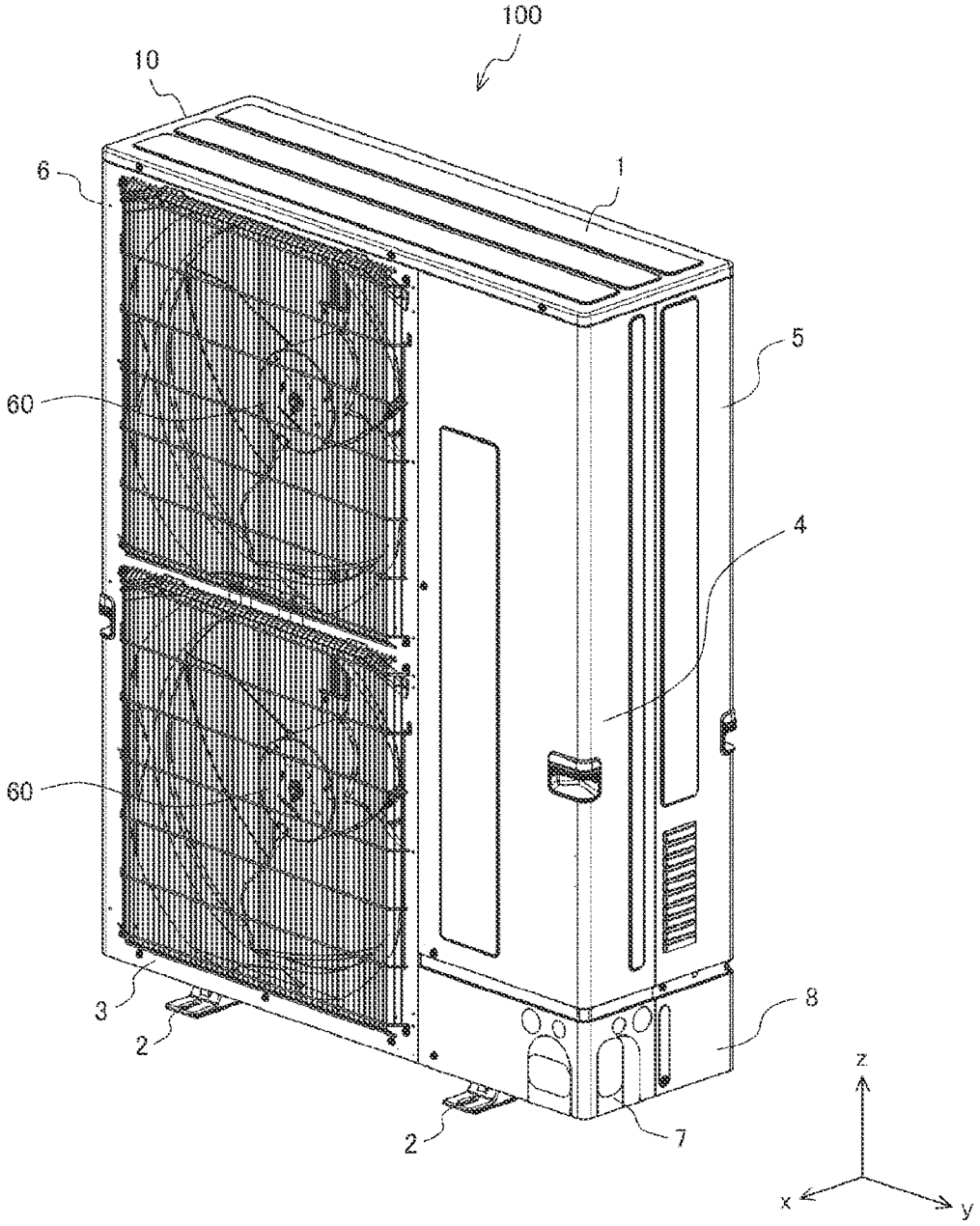
FIG. 2 is a perspective view illustrating the external appearance of the outdoor unit shown in FIG. 1.
Figure 3:
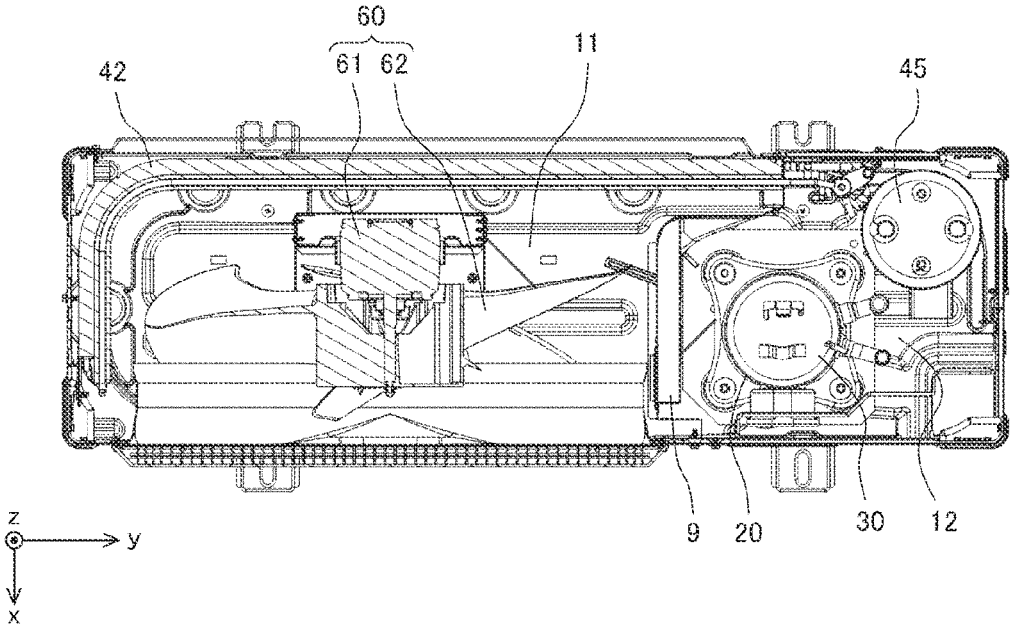
FIG. 3 is a schematic cross-sectional view showing the outdoor unit shown in FIG. 2 as viewed from above, and taken along an xy plane at the height of a fan motor of an upper outdoor air-sending device.
Figure 4:
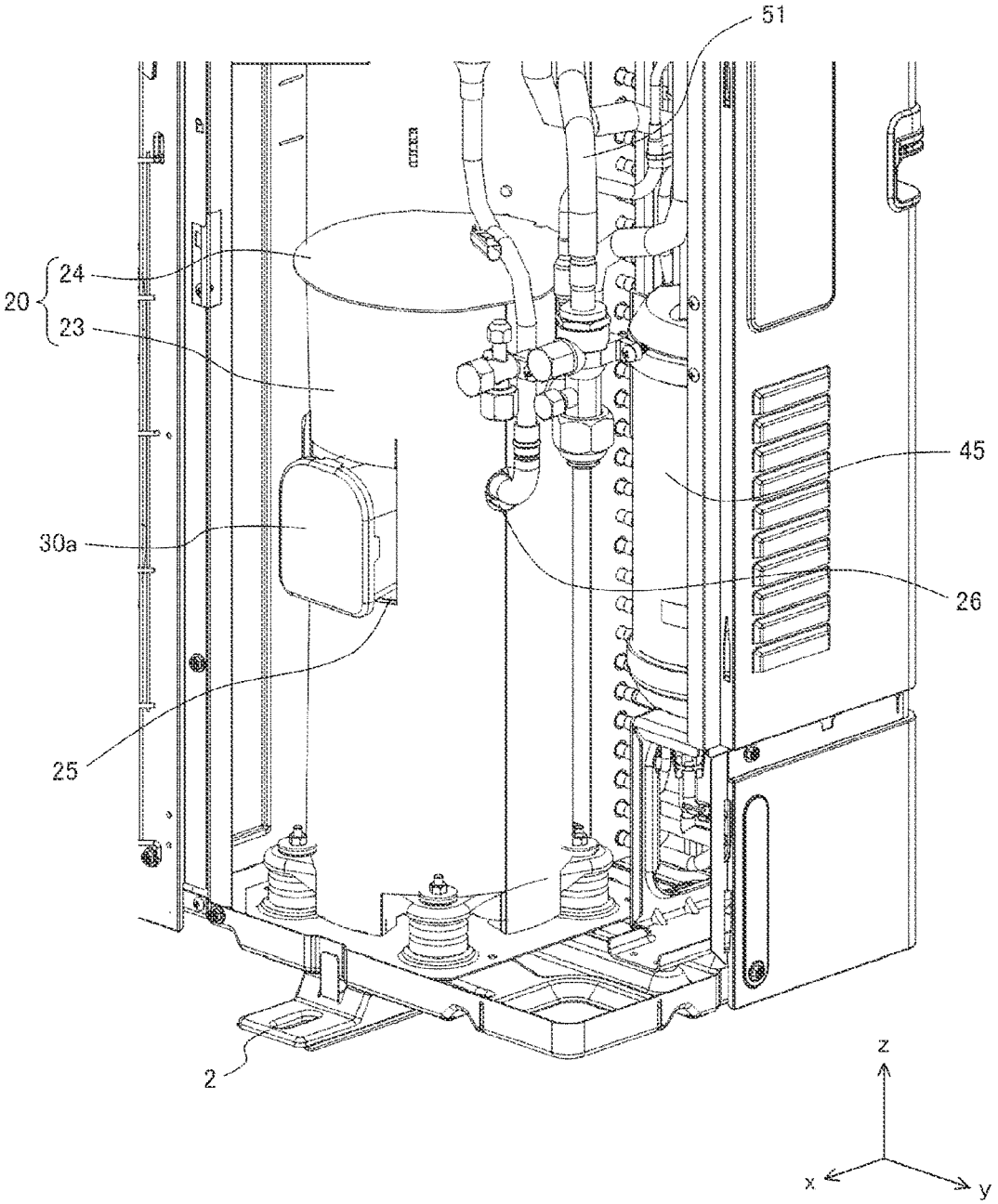
FIG. 4 is a perspective view illustrating the external appearance of the compressor installed in the outdoor unit shown in FIG. 2.

FIG. 2 is a perspective view illustrating the external appearance of the outdoor unit shown in FIG. 1. FIG. 3 is a schematic cross-sectional view showing the outdoor unit shown in FIG. 2 as viewed from above, and taken along an xy plane at the height of the fan motor of an upper outdoor air-sending device. FIG. 4 is a perspective view illustrating the external appearance of the compressor installed in the outdoor unit shown in FIG. 2.

In FIG. 2 to FIG. 4, the longitudinal direction of the outdoor unit 100 corresponds to the direction of the x axis, the lateral direction of the outdoor unit 100 corresponds to the direction of the y axis, and the vertical direction of the outdoor unit 100 corresponds to the direction of the z axis. In the description made hereinafter, the positive direction along the y axis is named as the rightward direction, and the negative direction along the y axis is named as the leftward direction. The vertical direction is also referred to as "height direction", The structure, the direction and the like of the compressor 30 in FIG. 3 and FIG. 4 are merely for the sake of example, and the structure, the direction and the like of the compressor 30 are not limited to the above. The same applies to the respective drawings described hereinafter.

As shown in FIG. 2, the outdoor unit 100 includes a box-shaped casing 10 that forms the outer shell of the outdoor unit 100. The compressor 30, the four-way valve 41, the heat-source-side heat exchanger 42, and the expansion valve 43 are accommodated in the casing 10. The casing 10 includes, as outer shell parts of the outdoor unit 100, a top panel 1, a base 2, a front panel 3, a service panel 4, a right side panel 5, a left side panel 6, a front cover panel 7, a rear cover panel 8, and a separator 9. Although not shown in FIG. 1, the refrigerant circuit 50 is provided with a pressure vessel 45 that stores refrigerant at a predetermined pressure.

As shown in FIG. 3, the space in the casing 10 is roughly separated into an air-sending device chamber 11 and a machine chamber 12 by the separator 9. The heat-source-side heat exchanger 42 and the heat-source-side air-sending devices 60 are mounted in the air-sending device chamber 11. The compressor 30, the refrigerant pipe 51, electrical components and the like are mounted in the machine chamber 12.

In general, the outer shell parts of the outdoor unit are made of sheet metal, and each outer shell part has sound insulating properties. Affixing a sound absorbing material, such as an insulation, to the outer shell part further increases sound transmission loss. However, recently, due to significantly high energy saving performance and a significant reduction in the size of the outdoor unit, there is a tendency that sound generated from the compressor increases. For this reason, merely attaching the sound absorbing material to the outer shell part cannot sufficiently minimize sound leakage to outside the outdoor unit.

In view of the above, as shown in FIG. 4, a soundproof part 20 for the compressor is attached to the compressor 30 in Embodiment 1. The soundproof part 20 is made of a side surface cover 23 and an upper surface cover 24. FIG. 4 is a perspective view partially showing the compressor 30 of the outdoor unit 100 shown in FIG. 2 and an area around the compressor 30 in a state where the service panel 4 and the front cover panel 7 are removed.

FIG. 4 illustrates the compressor 30 of a type where a terminal cover 30*a* is disposed at the front. Therefore, the soundproof part 20 has a notch 25 into which the terminal cover 30*a* is inserted. The soundproof part 20 also has a through hole 26 that allows a pipe protruding from the compressor 30 to pass therethrough. The soundproof part 20 may adopt any of various shapes according to the shape of the compressor 30.

Figure 5:
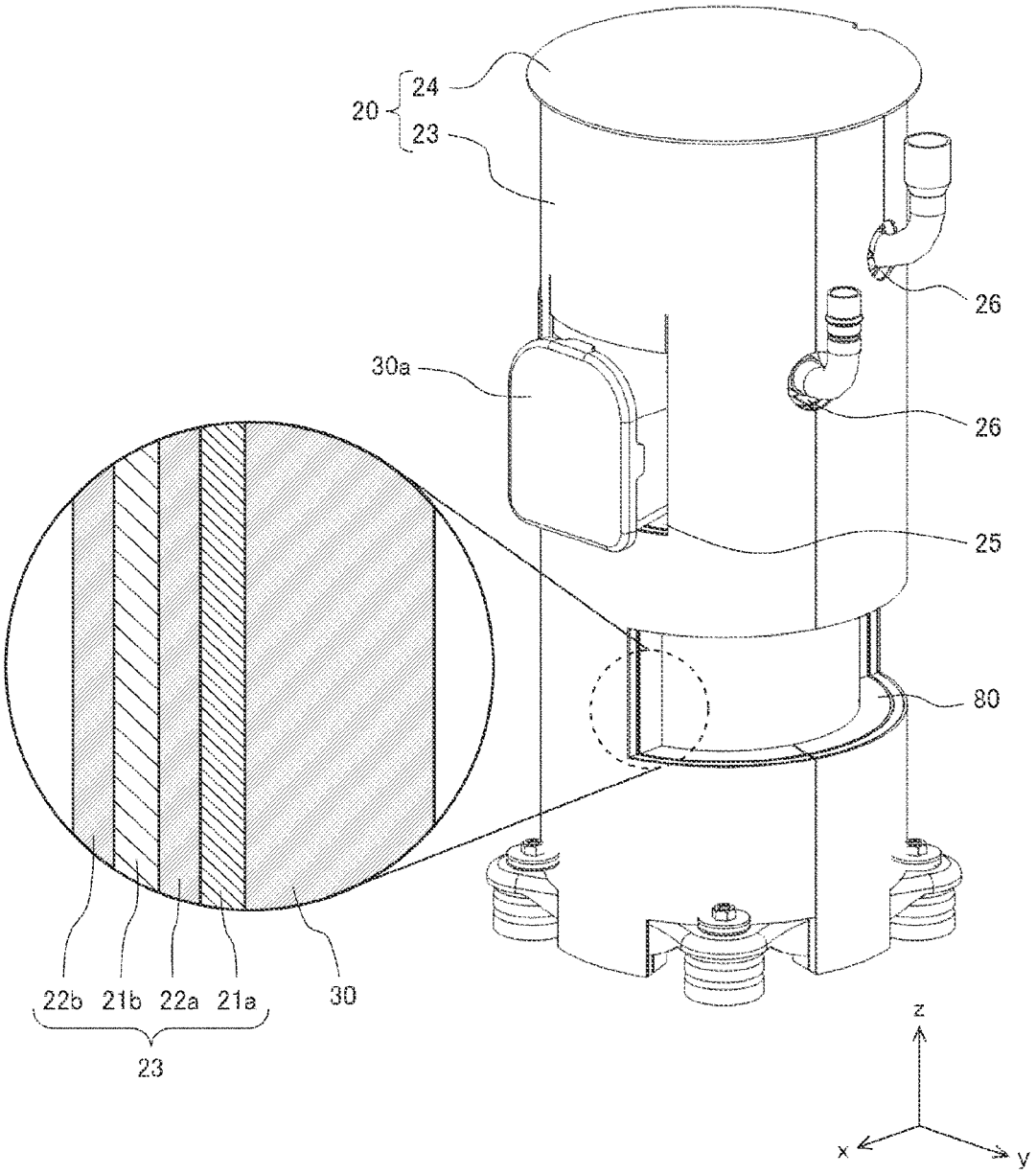
FIG. 5 is a perspective view illustrating the compressor shown in FIG. 4 and a soundproof part.

FIG. 5 is a perspective view illustrating the compressor shown in FIG. 4 and the soundproof part. To show the cross sectional shape of the side surface cover 23, FIG. 5 illustrates a state where a portion of the side surface cover 23 and a portion of the compressor 30 are schematically cut (see imaginary cut-away portion 80). However, the side surface cover 23 and the compressor 30 do not actually have a cut-away portion. FIG. 5 also includes an enlarged schematic cross-sectional view obtained by partially extracting the cross sectional shape of the imaginary cut-away portion 80.

The side surface cover 23 is a cover that covers the side surface of the compressor 30. In other words, the side surface cover 23 is caused to wind around the compressor 30 to cover the side surface of the compressor 30. The side surface cover 23 is made of a sound absorbing material 21*a*, a sound absorbing material 21*b*, a sound insulating material 22*a*, and a sound insulating material 22*b*. The upper surface cover 24 is a cover that covers the upper surface of the compressor 30.

As shown in FIG. 5, the side surface cover 23 adopts the configuration where the sound absorbing material 21*a*, the sound insulating material 22*a*, the sound absorbing material 21*b*, and the sound insulating material 22*b* are arranged in this order from the compressor 30. In other words, the side surface cover 23 is formed such that a sound absorbing material and a sound insulating material are alternately arranged. Therefore, the sound insulating material 22*a* is sandwiched between the sound absorbing material 21*a* and the sound absorbing material 21*b*, and the sound absorbing material 21*b* is sandwiched between the sound insulating material 22*a* and the sound insulating material 22*b*.

The side surface cover 23 is formed such that the sound absorbing material 21*a*, the sound insulating material 22*a*, the sound absorbing material 21*b*, and the sound insulating material 22*b* are joined by sewing. The side surface cover 23 may be formed such that the sound absorbing material 21*a*, the sound insulating material 22*a*, the sound absorbing material 21*b*, and the sound insulating material 22*b* are joined by bonding by an adhesive agent or by other methods. The side surface cover 23 may also be formed by the combination of joining by sewing and bonding by adhesive agent. When the side surface cover 23 is formed as described above, the durable side surface cover 23 can be manufactured at a low cost. Particularly, when the side surface cover 23 is formed by a method including sewing, resistance against deterioration over time or the like can be improved.

The sound absorbing material 21*a* is a sheet-shaped sound absorbing material formed by using, as a material, felt, glass wool, or other materials, for example. The sound absorbing material 21*a* is disposed adjacent to the compressor 30. The sound insulating material 22*a* is a sheet-shaped sound insulating material formed by using, as a material, butyl rubber having a specific gravity of approximately 2.6, rubber having a specific gravity of approximately 2.4, or other materials, for example. The sound absorbing material 21*b* is a sheet-shaped sound absorbing material formed using, as a material, felt, glass wool, or other materials, for example. The sound insulating material 22*b* is a sheet-shaped sound insulating material formed using, as a material, rubber having a specific gravity of approximately 2.4, ethylene-propylene-diene rubber (EPDM) having a specific gravity of approximately 0.87, or other materials, for example.

In Embodiment 1, the side surface cover 23 is formed such that, with regard to the material of the sound insulating material, as a distance from the compressor 30 increases, the sound insulating material having relatively lower specific gravities are disposed. In other words, the side surface cover 23 is formed such that the sound insulating material disposed farther from the compressor 30 has a relatively lower specific gravity than the sound insulating material disposed closer to the compressor 30.

Accordingly, in the side surface cover 23 illustrated in FIG. 5, the sound insulating material 22*b* disposed farther from the compressor 30 has a lower specific gravity than the specific gravity of the sound insulating material 22*a* disposed closer from the compressor 30. For example, when the sound insulating material 22*a* is formed using butyl rubber as a material, rubber or ethylene-propylene-diene rubber may be adopted as a material for forming the sound insulating material 22*b*. Further, when the sound insulating material 22*a* is formed using rubber as a material, ethylene-propylene-diene rubber may be adopted as a material for forming the sound insulating material 22*b*.

The upper surface cover 24 is formed by laminating a sheet-shaped sound absorbing material formed using felt, glass wool, or other materials, for example, as a material, and a sheet-shaped sound insulating material formed using rubber, butyl rubber, ethylene-propylene-diene rubber, or other rubber as a material. The sound absorbing material and the sound insulating material are joined by at least one of sewing and bonding by an adhesive agent. The upper surface cover 24 in Embodiment 1 is formed such that the sound absorbing material is disposed at a position closest to the compressor 30. In the same manner as the side surface cover 23, the upper surface cover 24 may also have a four-layered structure. However, in Embodiment 1, by taking into account ease of attachment of the upper surface cover 24 to the compressor 30, the upper surface cover 24 has a two-layered structure made of the sound absorbing material and the sound insulating material.

Figure 6:
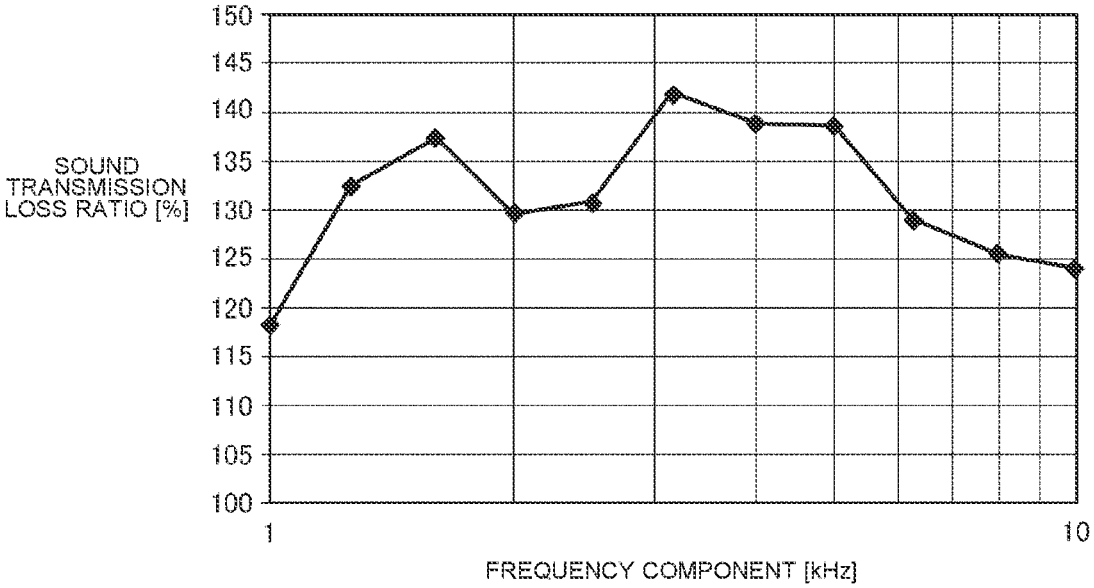
FIG. 6 is a graph illustrating a sound transmission loss ratio that is a ratio of sound transmission loss of the soundproof part shown in FIG. 5 to sound transmission loss of a related-art soundproof part.

FIG. 6 is a graph illustrating a sound transmission loss ratio that is a ratio of sound transmission loss of the soundproof part shown in FIG. 5 to sound transmission loss of a related-art soundproof part. In FIG. 6, the horizontal axis represents a frequency component [kHz], and the vertical axis represents a sound transmission loss ratio [%]. In the soundproof part 20 used in FIG. 6, the sound absorbing material 21*a* and the sound absorbing material 21*b* are made of felt, the sound insulating material 22*a* is made of butyl rubber, and the sound insulating material 22*b* is made of rubber. In FIG. 6, the related-art soundproof part used for the comparison with the soundproof part 20 adopts a configuration substantially equal to the configuration of the soundproof part disclosed in Patent Literature 1. Data for obtaining sound transmission loss is acquired in a state where the outer periphery of the compressor 30 is covered by the related-art soundproof part in the same manner as the soundproof part 20.

In Embodiment 1, sound transmission loss is an index indicating performance of insulating sound transmitted through air. A material having larger sound transmission loss has more excellent sound insulating performance. Therefore, in FIG. 6, within a range where a sound transmission loss ratio is more than 100%, the soundproof part 20 has a larger sound transmission loss than the related-art soundproof part, thus having more excellent sound insulating performance.

As shown in FIG. 6, the soundproof part 20 has a sound transmission loss ratio of 118% or more at least with regard to sound within the entire range from a frequency of 1 kHz to a frequency of 10 kHZ. In other words, at least with regard to the sound within the entire range from the frequency of 1 kHz to the frequency of 10 kHZ, sound transmission loss of the soundproof part 20 is significantly increased compared with the related-art soundproof part, so that the sound insulating performance of the soundproof part 20 is greatly improved.

As described above, the side surface cover 23 is formed such that the sound absorbing material and the sound insulating material are alternately arranged, and as the distance from the compressor 30 increases, the sound insulating material having relatively lower specific gravities are disposed and hence, sound insulating performance can be increased. Accordingly, it is possible to prevent leakage of sound generated from the compressor 30 to the outside of the outdoor unit 100 with a simple structure. That is, as also illustrated in FIG. 6, it is possible to provide the soundproof part 20 having relatively larger sound transmission loss than the related-art soundproof part.

In other words, in the side surface cover 23, the sound absorbing material disposed adjacent to the compressor 30 is sandwiched between the compressor 30 and the sound insulating material and hence, sound generated from the compressor 30 and passing through the sound absorbing material can be reflected on the sound insulating material toward the compressor 30. Further, in the side surface cover 23, the sound absorbing material that is not disposed adjacent to the compressor 30 is sandwiched between two sound insulating materials and hence, it is possible to cause sound that passes through the sound absorbing material to travel back and forth between the two sound insulating materials. Therefore, also with the configuration where the side surface cover 23 includes two or more sound absorbing materials, the side surface cover 23 can increase the number of propagation paths through which the sound absorbing material absorbs sound and hence, a sound absorption coefficient can be increased. In the side surface cover 23, the plurality of sound insulating materials are arranged such that the specific gravities reduce toward the outside from the compressor 30 and hence, sound insulating performance can be improved. Therefore, according to the side surface cover 23, it is possible, with a simple structure, to significantly reduce sound generated from the compressor 30 and having a frequency of 1 kHz or more that is likely to be acoustically heard as noise.

In addition to the above, the side surface cover 23 is formed such that the sound insulating material having a relatively low specific gravity is disposed at a position close to the outside as described above. Therefore, it is possible to avoid the situation where the outer sound insulating material disposed at a position far from the center of gravity hangs downward. Accordingly, the deformation and displacement of the soundproof part 20 can be prevented and hence, the soundproof part 20 can stably maintain sound insulating performance.

Further, in the side surface cover 23, two or more sound absorbing materials and two or more two sound insulating materials can be joined by the combination of sewing and bonding. When the side surface cover 23 is formed as described above, the durable side surface cover 23 can be manufactured, and a manufacturing cost of the side surface cover 23 can be reduced.

By taking into account workability in winding the side surface cover 23 around the compressor 30, it is preferable that the side surface cover 23 have a four-layered structure made of two sound absorbing materials and two sound insulating materials. From such a viewpoint, the side surface cover 23 shown in FIG. 5 is formed by arranging the sound absorbing material 21*a*, the sound insulating material 22*a*, the sound absorbing material 21*b*, and the sound insulating material 22*b* in this order from the compressor 30. Therefore, the side surface cover 23 can significantly prevent sound leakage, and can be attached to the compressor 30 more easily.

FIG. 5 illustrates the side surface cover 23 including two sound absorbing materials and two sound insulating materials. However, the configuration of the side surface cover 23 is not limited to the above. The side surface cover 23 may include three or more sound absorbing materials, and may include three or more sound insulating materials. In other words, it is sufficient for the side surface cover 23 to include two or more sound absorbing materials and two or more sound insulating materials. However, it is necessary to form the side surface cover 23 such that one sound absorbing material is disposed adjacent to the compressor 30, and the sound absorbing material and the sound insulating material are alternately arranged. For this reason, it is necessary to form the side surface cover 23 such that the number of sound absorbing materials and the number of sound insulating materials are equal to each other, or the number of sound absorbing materials is greater than the number of sound insulating materials by one.

When the sound absorbing material is disposed at the outermost position in the side surface cover 23, sound that passes through the sound absorbing material toward the outside cannot be reflected on the sound insulating material. For this reason, it is preferable to form the side surface cover 23 such that the number of sound absorbing materials and the number of sound insulating materials are set equal to each other, and the sound insulating material is disposed at the outermost position. With such a configuration, it is possible to increase the number of propagation paths through which the sound absorbing material absorbs sound and hence, a sound absorption coefficient can be increased.

In a case where the side surface cover 23 includes three or more sound insulating materials, and the included sound insulating materials have the same specific gravity, it is sufficient that, with regard to two sound insulating materials disposed adjacent to each other with the sound absorbing material interposed therebetween, the specific gravity of the sound insulating material disposed relatively closer to the compressor 30 be equal to or less than the specific gravity of the sound insulating material disposed relatively farther from the compressor 30. In other words, it is sufficient that the specific gravity of the sound insulating material closest to the compressor 30 be higher than the specific gravity of the outermost sound insulating material.

Modification Example 1

Figure 7:
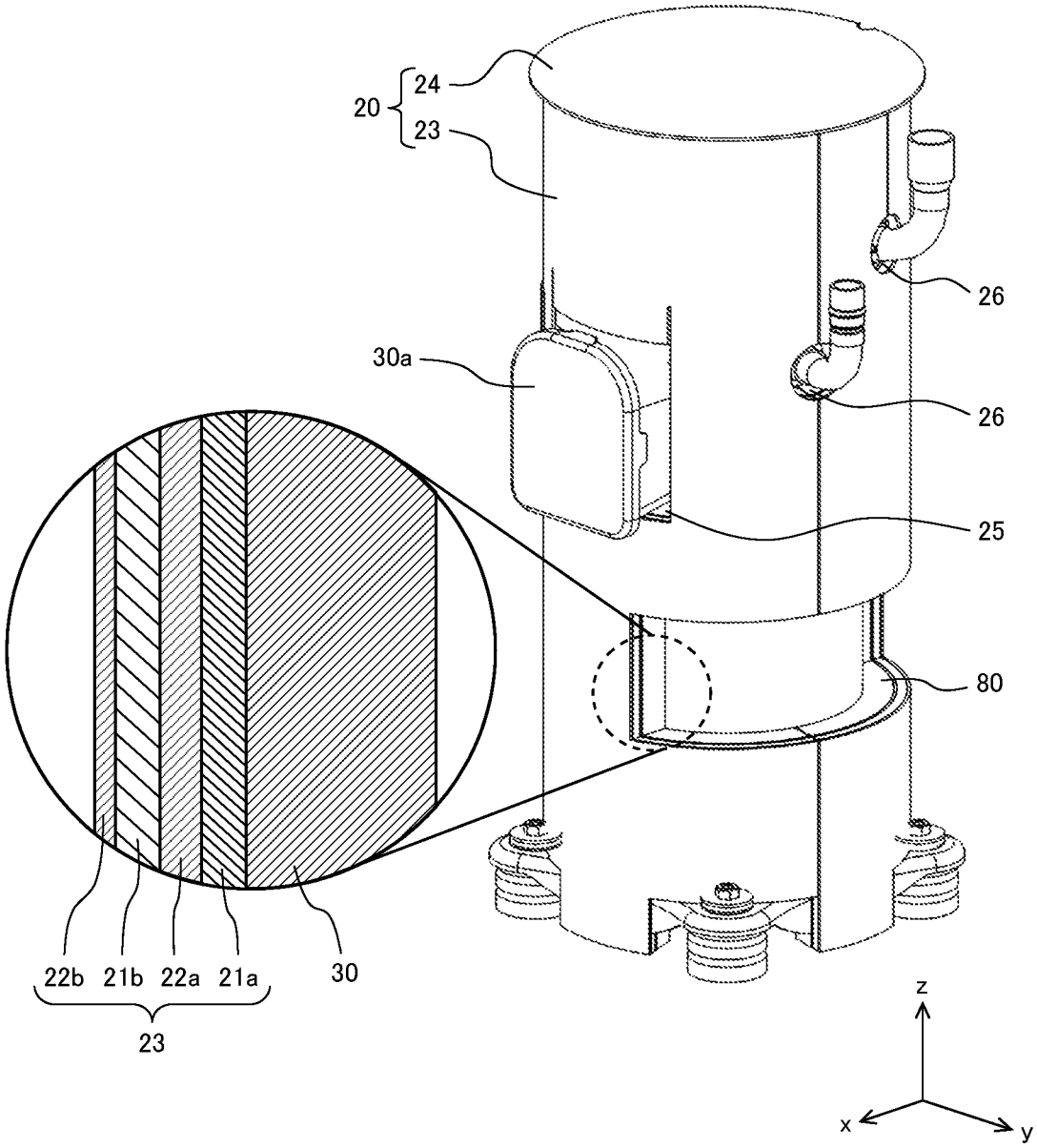
FIG. 7 is a perspective view illustrating the compressor according to Modification Example 1 of the present disclosure.

FIG. 7 is a perspective view illustrating the compressor according to Modification Example 1 of the present disclosure. In the above-mentioned description, the description has been made taking into the case where the plurality of sound insulating materials have the same thickness. However, as shown in FIG. 7, the soundproof part 20 of Modification Example 1 is formed such that as a distance from the compressor 30 increases, the sound insulating materials having relatively smaller thicknesses are disposed. In the case of the configuration shown in FIG. 7, for example, the sound insulating material 22*a* is formed into a sheet shape having a thickness of 1.6 mm using butyl rubber as a material, and the sound insulating material 22*b* is formed into a sheet shape having a thickness of 1.4 mm using rubber as a material.

As described above, the soundproof part 20 of Modification Example 1 is formed such that as the distance from the compressor 30 increases, the sound insulating materials having relatively smaller thicknesses are disposed. Therefore, sound transmission loss can be further increased and hence, sound insulating performance can be improved. Further, the center of gravity of the sound insulating materials can be set at a position close to the compressor 30 and hence, ease of winding the soundproof part 20 can be increased whereby workability can be improved.

Modification Example 2

Figure 8:
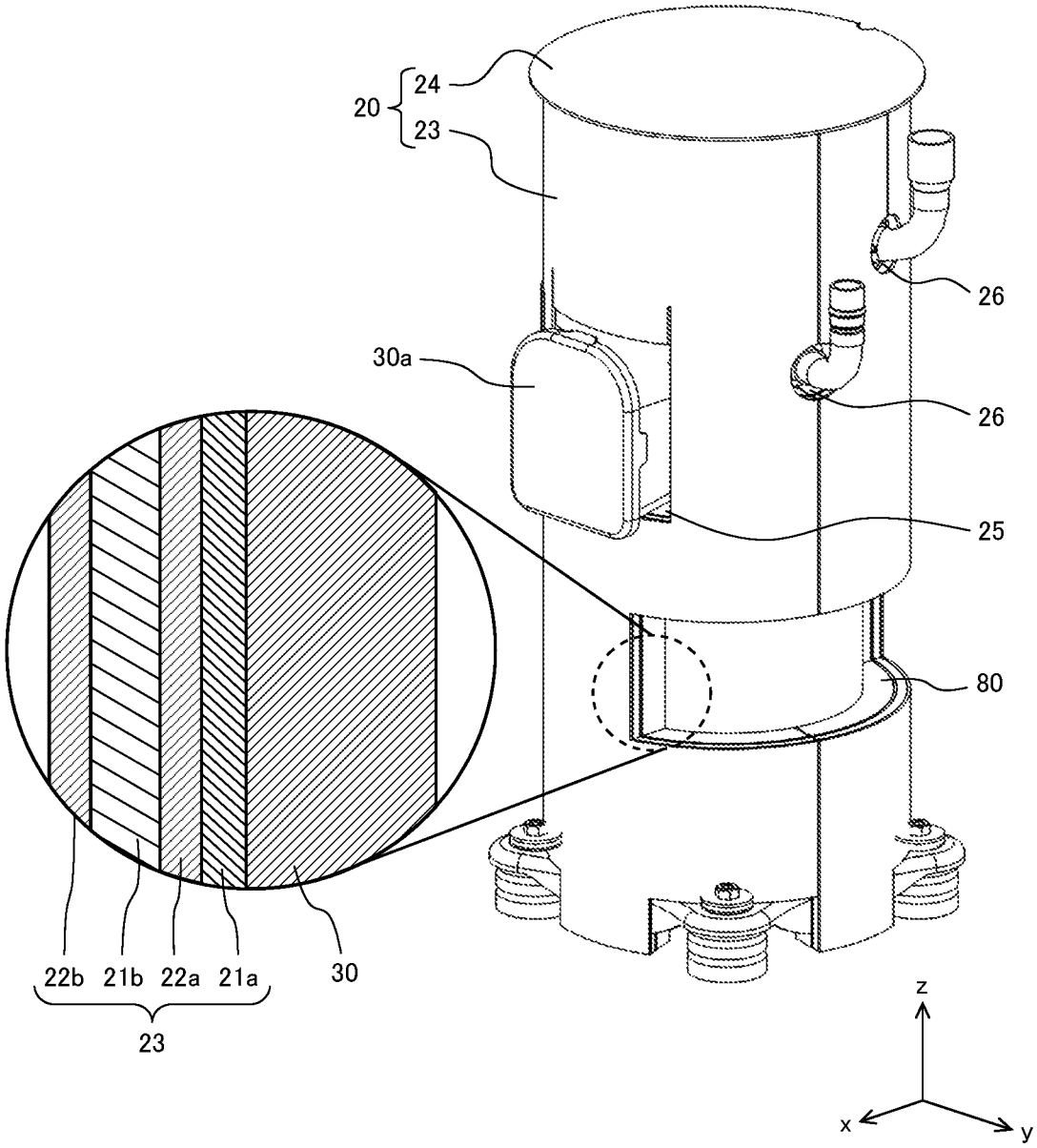
FIG. 8 is a perspective view illustrating the compressor according to Modification Example 2 of the present disclosure.

FIG. 8 is a perspective view illustrating the compressor according to Modification Example 2 of the present disclosure. In the above-mentioned description, the description has been made presuming the case where the plurality of sound absorbing materials have the same thickness. However, as shown in FIG. 8, the soundproof part 20 of Modification Example 2 is formed such that as a distance from the compressor 30 increases, the sound absorbing materials having relatively larger thicknesses are disposed. In the case of the configuration shown in FIG. 8, for example, the sound absorbing material 21*a* is formed into a sheet shape having a thickness of 5 mm using felt as a material, and the sound absorbing material 21*b* is formed into a sheet shape having a thickness of 15 mm using felt as a material.

As described above, the soundproof part 20 of Modification Example 2 is formed such that as the distance from the compressor 30 increases, the sound absorbing materials having relatively larger thicknesses are disposed. Therefore, sound transmission loss can be further increased and hence, sound insulating performance can be improved.

Modification Example 3

The soundproof part 20 of Modification Example 3 adopts the configuration obtained by combining Modification Example 1 and Modification Example 2. In other words, the soundproof part 20 of Modification Example 3 is formed such that as a distance from the compressor 30 increases, the sound insulating material having relatively smaller thicknesses are disposed, and the sound absorbing material having relatively larger thicknesses are disposed. Therefore, according to the soundproof part 20 of Modification Example 3, sound insulating performance can be further increased, and workability can be improved.

Modification Example 4

The soundproof part 20 of Modification Example 4 is characterized in that a plurality of sound absorbing materials are made of different materials. When the sound absorbing material 21*a* is formed using felt as a material, for example, it is preferable to form the sound absorbing material 21*b* using glass wool as a material. Further, when the sound absorbing material 21*a* is formed by using glass wool as a material, it is preferable to form the sound absorbing material 21*b* using felt as a material.

The soundproof part 20 of Modification Example 4 is formed such that at least two sound absorbing materials include sound absorbing materials made of different materials. In other words, in Modification Example 4, by taking into account the material of the adjacent sound insulating material, the plurality of sound absorbing materials forming the soundproof part 20 are selected such that sound transmission loss is reduced. In other words, the soundproof part 20 of Modification Example 4 is formed such that the sound absorbing materials are selected according to the materials of the respective sound insulating materials and hence, sound insulating performance can be improved. The configuration of the above-mentioned Modification Examples 1 to 3 is applicable to the configuration of Modification Example 4.

Embodiment 2

Figure 9:
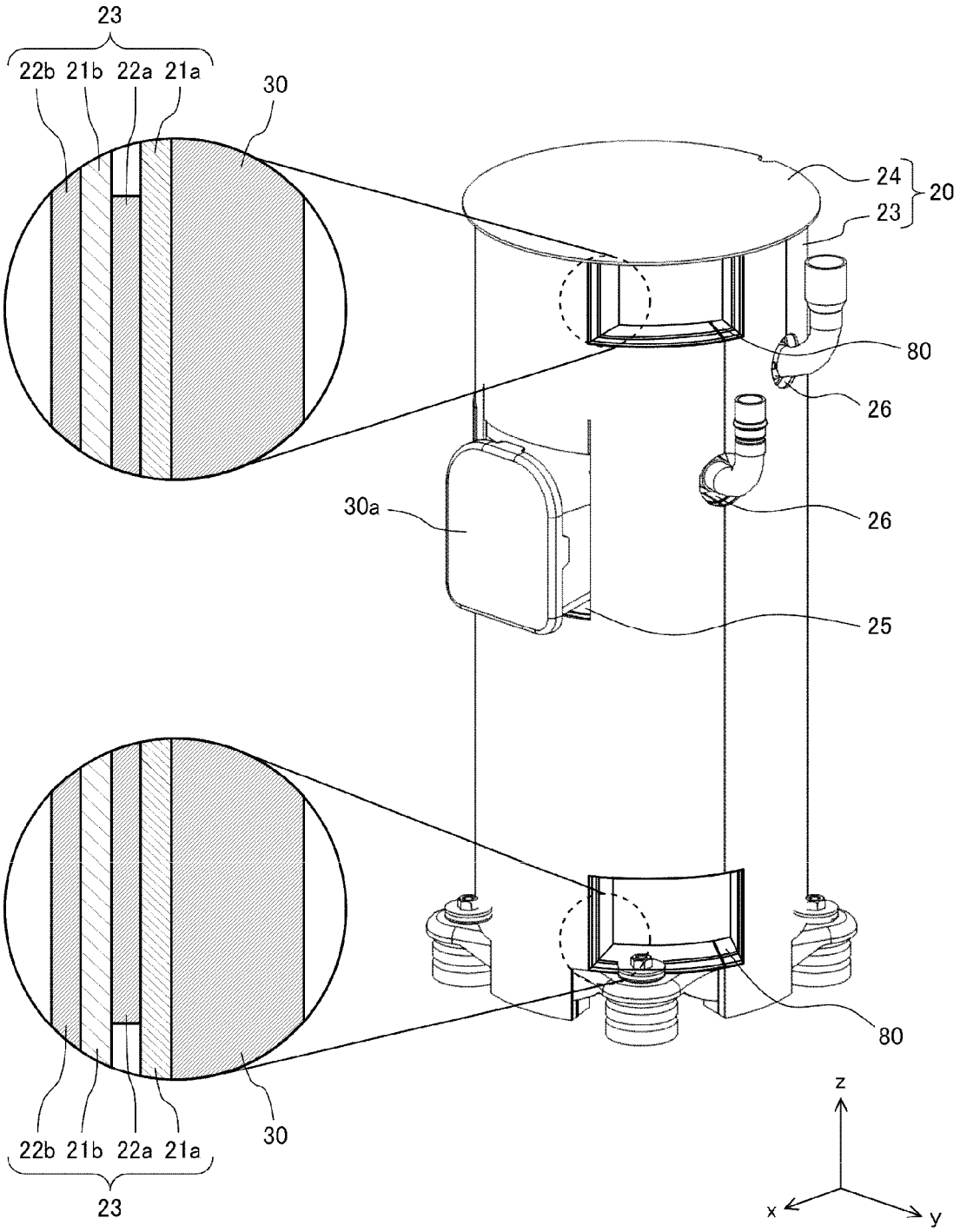
FIG. 9 is a perspective view illustrating a compressor and a soundproof part included by an outdoor unit of an air-conditioning apparatus according to Embodiment 2 of the present disclosure.

The overall configuration of an outdoor unit of an air-conditioning apparatus according to Embodiment 2 is substantially equal to that of the above-mentioned Embodiment 1 and hence, parts identical to corresponding parts in Embodiment 1 are given the same reference symbols, and the description of such configuration parts will be omitted. FIG. 9 is a perspective view illustrating a compressor and a soundproof part included by the outdoor unit of the air-conditioning apparatus according to Embodiment 2 of the present disclosure. In the same manner as FIG. 5, FIG. 9 also includes enlarged schematic cross-sectional views each of which is obtained by partially extracting the cross sectional shape of each of two imaginary cut-away portions 80. FIG. 9 illustrates the side surface cover 23 that includes two sound absorbing materials and two sound insulating materials. However, the configuration of the side surface cover 23 is not limited to the above. With the same limitations as Embodiment 1, the side surface cover 23 in Embodiment 2 may include three or more sound absorbing materials, and may include three or more sound insulating materials.

In the side surface cover 23 in Embodiment 2, the length in the height direction of the sound insulating material sandwiched between the two sound absorbing materials is smaller than the length in the height direction of the two sound absorbing materials that sandwich the sound insulating material. Whereas the length in the height direction of the sound insulating material that is not sandwiched between the two sound absorbing materials is equal to the length in the height direction of the sound absorbing material.

In the case of the configuration shown in FIG. 9, the length in the height direction of the sound insulating material 22*a* sandwiched between the sound absorbing material 21*a* and the sound absorbing material 21*b* is smaller than the length in the height direction of the sound absorbing material 21*a* and the sound absorbing material 21*b* that sandwich the sound insulating material 22*a*. It is sufficient that the length of the sound insulating material 22*a* be smaller than the length of the sound absorbing material 21*a* and the sound absorbing material 21*b* at the upper end portion and the lower end portion of the sound insulating material 22*a* to an extent that the sound absorbing material 21*a* and the sound absorbing material 21*b* can be brought into contact with each other to enable sewing these materials together. Whereas the length in the height direction of the sound insulating material 22*b* is equal to the length in the height direction of the sound absorbing material 21*a* and the sound absorbing material 21*b*. Therefore, the side surface cover 23 is brought into a state where the sound absorbing material 21*a*, the sound absorbing material 21*b*, and the sound insulating material 22*b* are joined with each other at the upper end portions and the lower end portions thereof, and the sound insulating material 22*a* is sandwiched between the sound absorbing material 21*a* and the sound absorbing material 21*b*.

As described above, also with the side surface cover 23 in Embodiment 2, it is possible to prevent leakage of sound generated from the compressor 30 to the outside of the outdoor unit 100 with a simple structure. Further, the side surface cover 23 in Embodiment 2 is formed such that the length in the height direction of the sound insulating material sandwiched between the two sound absorbing materials is smaller than the length in the height direction of the two sound absorbing materials that sandwich the sound insulating material. Therefore, when the respective sound absorbing materials and the sound insulating materials of the soundproof part 20 are joined with each other, the thickness of a portion where the materials are joined can be reduced and hence, workability can be improved.

In Embodiment 2, provided that a difference in size between the two sound absorbing materials and the sound insulating material sandwiched between the two sound absorbing materials is not larger than a predetermined value, the sound insulating material sandwiched between the two sound absorbing materials may have a shape different from the shape of the sound absorbing materials that sandwich the sound insulating material. Further, for example, when the side surface cover 23 is expanded, the length in the lateral direction of the sound insulating material sandwiched between the two sound absorbing materials may be smaller than the length in the lateral direction of the two sound absorbing materials that sandwich the sound insulating material. In addition to the above, any of the configurations of the above-mentioned modifications 1 to 4 and the combination of these configurations are also applicable to the side surface cover 23 in Embodiment 2. Other advantageous effects are substantially equal to those obtained in Embodiment 1.

Embodiment 3

Figure 10:
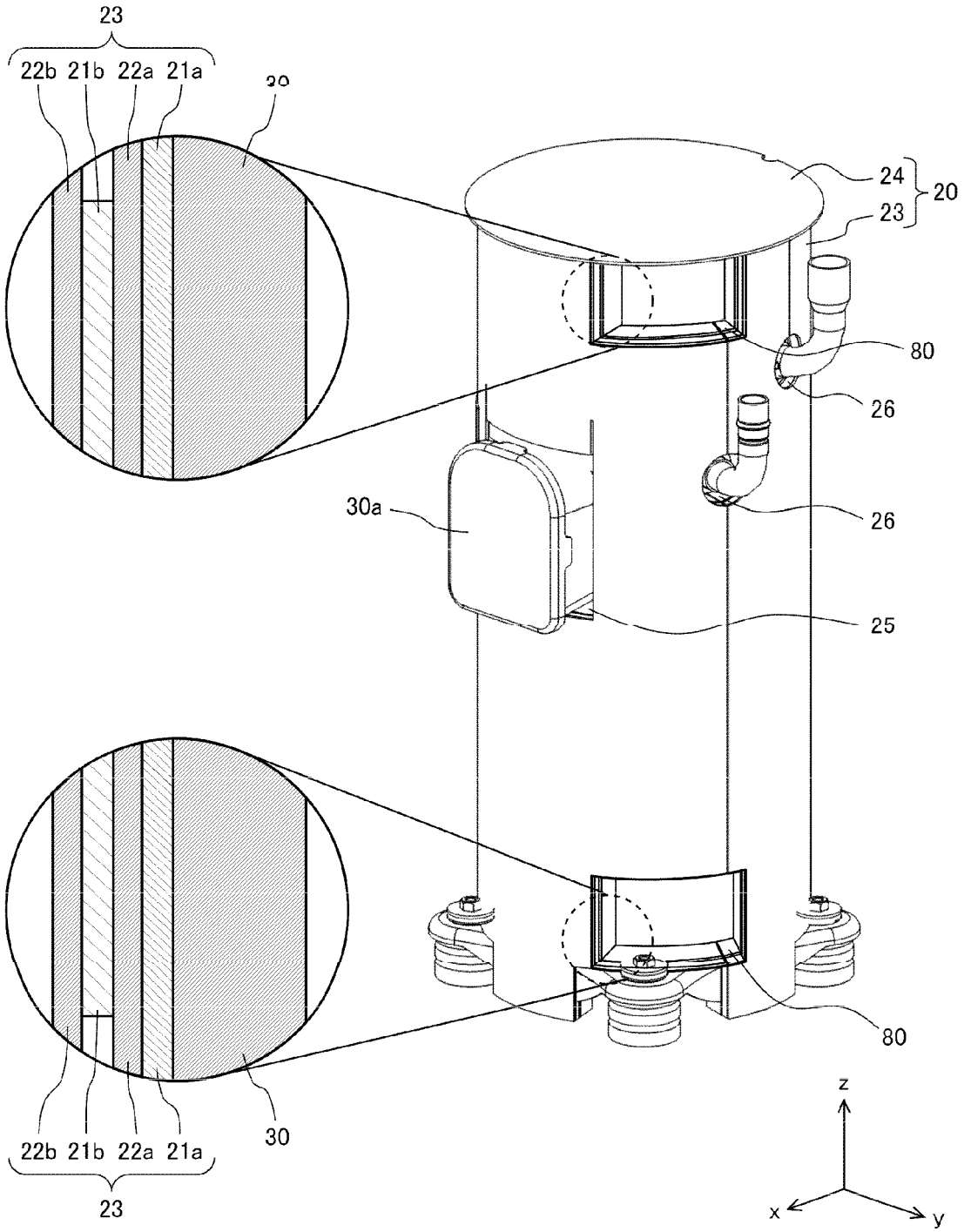
FIG. 10 is a perspective view illustrating a compressor and a soundproof part included by an outdoor unit of an air-conditioning apparatus according to Embodiment 3 of the present disclosure.

The overall configuration of an outdoor unit of an air-conditioning apparatus according to Embodiment 3 is substantially equal to that of the above-mentioned Embodiment 1 and 2 and hence, parts identical to corresponding parts in the Embodiments 1 and 2 are given the same reference symbols, and the description of such parts will be omitted. FIG. 10 is a perspective view illustrating a compressor and a soundproof part included by the outdoor unit of the air-conditioning apparatus according to Embodiment 3 of the present disclosure. In the same manner as FIG. 9, FIG. 10 also includes enlarged schematic cross-sectional views each of which is obtained by partially extracting the cross sectional shape of each of two imaginary cut-away portions 80. FIG. 10 illustrates the side surface cover 23 that includes two sound absorbing materials and two sound insulating materials. However, the configuration of the side surface cover 23 is not limited to the above. With the same limitations as Embodiment 1, the side surface cover 23 in Embodiment 3 may include three or more sound absorbing materials, and may include three or more sound insulating materials.

In the side surface cover 23 in Embodiment 3, the length in the height direction of the sound absorbing material sandwiched between the two sound insulating materials is smaller than the length in the height direction of the two sound insulating materials that sandwich the sound absorbing material. Whereas the length in the height direction of the sound absorbing material that is not sandwiched between the two sound insulating materials is equal to the length in the height direction of the sound insulating material.

In the case of the configuration shown in FIG. 10, the length in the height direction of the sound absorbing material 21*b* sandwiched between the sound insulating material 22*a* and the sound insulating material 22*b* is smaller than the length in the height direction of the sound insulating material 22*a* and the sound insulating material 22*b* that sandwich the sound absorbing material 21*b*. It is sufficient that the length of the sound absorbing material 21*b* be smaller than the length of the sound insulating material 22*a* and the sound insulating material 22*b* at the upper end portion and the lower end portion of the sound absorbing material 21*b* to an extent that the sound insulating material 22*a* and the sound insulating material 22*b* can be brought into contact with each other to enable sewing these materials together. Whereas the length in the height direction of the sound absorbing material 21*a* is equal to the length in the height direction of the sound insulating material 22*a* and the sound insulating material 22*b*. Therefore, the side surface cover 23 is brought into a state where the sound absorbing material 21*a*, the sound insulating material 22*a*, and the sound insulating material 22*b* are joined with each other at the upper end portions and the lower end portions thereof, and the sound absorbing material 21*b* is sandwiched between the sound insulating material 22*a* and the sound insulating material 22*b*.

As described above, also with the side surface cover 23 in Embodiment 3, it is possible to prevent leakage of sound generated from the compressor 30 to outside the outdoor unit 100 with a simple structure. The side surface cover 23 in Embodiment 3 is formed such that the length in the height direction of the sound absorbing material sandwiched between the two sound insulating materials is smaller than the length in the height direction of the two sound insulating materials that sandwich the sound absorbing material. Therefore, when the respective sound absorbing materials and the sound insulating materials of the soundproof part 20 are joined with each other, the thickness of a portion where the materials are joined can be reduced and hence, workability can be improved.

In Embodiment 3, provided that a difference in size between the two sound insulating materials and the sound absorbing material sandwiched between the two sound insulating materials is not larger than a predetermined value, the sound absorbing material sandwiched between the two sound insulating materials may have a shape different from the shape of the sound insulating materials that sandwich the sound absorbing material. Further, for example, when the side surface cover 23 is expanded, the length in the lateral direction of the sound absorbing material sandwiched between the two sound insulating materials may be smaller than the length in the lateral direction of the two sound insulating materials that sandwiches the sound absorbing material. In addition to the above, any of the configurations of the above-mentioned modifications 1 to 4 and the combination of these configurations are also applicable to the side surface cover 23 in Embodiment 3. Other advantageous effects are substantially equal to those obtained in Embodiment 1.

The above-mentioned respective embodiments merely form preferred specific examples of the soundproof part and the outdoor unit of the air-conditioning apparatus, and the technical scope of the present disclosure is not limited to these embodiments. In the above-mentioned description, sewing and bonding by an adhesive agent are described as an example of a method for joining the side surface cover 23 or the upper surface cover 24. However, such a method is not limited to the above. The side surface cover 23 or the upper surface cover 24 may be formed by fixing these members using a stapler, or by bonding these members to each other with a double-sided adhesive tape. In addition to the above, the side surface cover 23 or the upper surface cover 24 may be formed by the combination of at least two of sewing, bonding by an adhesive agent, fixing using a stapler, and bonding with a double-sided adhesive tape.

FIG. 5, FIG. 9, and FIG. 10 illustrate the case where the side surface cover 23 and the upper surface cover 24 are formed as separated parts. However, the configurations of the side surface cover 23 and the upper surface cover 24 are not limited to the above, and the side surface cover 23 and the upper surface cover 24 may be formed as an integral body. Further, the soundproof part 20 may be formed such that the side surface cover 23 covers not only the side surface, but also the upper surface of the compressor 30. In this case, the soundproof part 20 may not necessarily include the upper surface cover 24.

REFERENCE SIGNS LIST

1 top panel 2 base 3 front panel 4 service panel 5 right side panel 6 left side panel 7 front cover panel 8 rear cover panel 9 separator (partition plate) 10 casing 11 air-sending device chamber 12 machine chamber 20 soundproof part 21*a*, 21*b* sound absorbing material 22*a*, 22*b* sound insulating material 23 side surface cover 24 upper surface cover 25 notch 26 through hole 30 compressor 30*a* terminal cover 41 four-way valve 42 heat-source-side heat exchanger 43 expansion valve 44 load-side heat exchanger 45 pressure vessel 50 refrigerant circuit 51 refrigerant pipe 60 heat-source-side air-sending device 61 fan motor 62 fan 70 load-side air-sending device 100 outdoor unit 200 indoor unit 300 air-conditioning apparatus.

The invention claimed is:

1. A soundproof part that covers a compressor, the soundproof part comprising:

a side surface cover including two or more sound absorbing materials and two or more sound insulating materials, and configured to cover a side surface of the compressor, wherein at least one of the two or more sound insulating materials has a specific gravity different from a specific gravity of another of the two or more sound insulating materials, and the side surface cover is formed such that one of the two or more sound absorbing materials is disposed adjacent to the compressor, and the two or more sound absorbing materials and the two or more sound insulating materials are alternately arranged, the two or more sound insulating materials are arranged in order of specific gravity such that a sound insulating material of the two or more sound insulating materials having a highest specific gravity is disposed closest to the compressor and a sound insulating material of the two or more sound insulating materials having a lowest specific gravity is disposed farthest from the compressor, and a length in a height direction of at least one of a sound absorbing material of the two or more sound absorbing materials sandwiched between two sound insulating materials of the two or more sound insulating materials is smaller than a length in a height direction of the two sound insulating materials of the two or more sound insulating materials that sandwich said at least one of a sound absorbing material of the two or more sound absorbing materials.

2. The soundproof part of claim 1, wherein the side surface cover is formed such that the two or more sound absorbing materials are arranged in order of thickness such that a sound absorbing material of the two or more sound absorbing materials having a smallest thickness is disposed closest to the compressor and a sound absorbing material of the two or more sound absorbing materials having a largest thickness is disposed farthest from the compressor.

3. The soundproof part of claim 1, wherein the side surface cover is formed such that the two or more sound insulating materials are arranged in order of thickness such that a sound insulating material of the two or more sound insulating materials having a largest thickness is disposed closest to the compressor and a sound insulating material of the two or more sound insulating materials having a smallest thickness is disposed farthest from the compressor.

4. The soundproof part of claim 1, wherein the two or more sound absorbing materials include sound absorbing materials made of different materials.

5. The soundproof part of claim 1, wherein the side surface cover is formed such that the two or more sound absorbing materials and the two or more sound insulating materials are joined with each other by a combination of sewing and bonding.

6. The soundproof part of claim 1, wherein the side surface cover is formed such that the number of the sound absorbing materials is equal to the number of the sound insulating materials.

7. The soundproof part of claim 1, wherein the side surface cover includes only two of said sound absorbing materials and only two of said sound insulating materials.

8. An outdoor unit of an air-conditioning apparatus, the outdoor unit comprising:

a compressor, a heat-source-side heat exchanger, and a heat-source-side air-sending device configured to send air to the heat-source-side heat exchanger; and the soundproof part of claim 1 configured to cover the compressor.

9. A soundproof part that covers a compressor, the soundproof part comprising:

a side surface cover including two or more sound absorbing materials and two or more sound insulating materials, and configured to cover a side surface of the compressor, wherein at least one of the two or more sound insulating materials has a different specific gravity from a specific gravity of another of the two or more sound insulating materials, and the side surface cover is formed such that one of the two or more sound absorbing materials is disposed adjacent to the compressor, and the at least two sound absorbing materials and the at least two sound insulating materials are alternately arranged, the two or more sound insulating materials are arranged in order of specific gravity such that a sound insulating material of the two or more sound insulating materials having a highest specific gravity is disposed closest to the compressor and a sound insulating material of the two or more sound insulating materials having a highest specific gravity is disposed farthest from the compressor, and a length in a height direction of at least one of a sound insulating material of the two or more sound insulating materials sandwiched between two sound absorbing materials of the two or more sound absorbing materials is smaller than a length in a height direction of the two sound absorbing materials of the two or more sound absorbing materials that sandwich said at least one of a sound insulating material of the two or more sound insulating materials.

* * * * *